US008317502B1

(12) United States Patent
Grey

(10) Patent No.: US 8,317,502 B1
(45) Date of Patent: Nov. 27, 2012

(54) TEXTURE PATTERN IMPRINTING APPARATUS

(76) Inventor: Ronald Grey, Stanton, CA (US)

( * ) Notice: Subject to any disclaimer, the term of this patent is extended or adjusted under 35 U.S.C. 154(b) by 300 days.

(21) Appl. No.: 12/590,395

(22) Filed: Nov. 6, 2009

(51) Int. Cl.
*B28B 7/02* (2006.01)
*B28B 1/26* (2006.01)

(52) U.S. Cl. ..... 425/63; 425/385; 264/333; 404/128

(58) Field of Classification Search ..... 425/385, 425/63; 254/333; 404/124, 128
See application file for complete search history.

(56) References Cited

U.S. PATENT DOCUMENTS

| | | | | |
|---|---|---|---|---|
| 3,523,343 | A * | 8/1970 | Mitchell | 425/88 |
| 3,775,529 | A * | 11/1973 | Steenson et al. | 264/162 |
| 3,936,209 | A | 2/1976 | Krage | |
| 3,969,056 | A * | 7/1976 | Larsen et al. | 425/218 |
| 4,266,917 | A * | 5/1981 | Godbersen | 425/64 |
| 4,280,800 | A * | 7/1981 | Bunn | 425/62 |
| 4,614,486 | A * | 9/1986 | Bragagnini | 425/62 |
| 5,002,817 | A | 3/1991 | Jones | |
| 5,167,991 | A | 12/1992 | Lowe | |
| 5,202,132 | A | 4/1993 | Myers | |
| 5,391,331 | A | 2/1995 | Baker | |
| 5,487,656 | A | 1/1996 | Kaitanjian | |
| 5,616,291 | A | 4/1997 | Belarde | |
| 5,942,181 | A | 8/1999 | Rondeau | |
| 6,923,630 | B2 * | 8/2005 | Allen | 425/63 |
| 7,524,180 | B1 | 4/2009 | Myers | |
| 2004/0247390 | A1 | 12/2004 | Smith | |
| 2008/0173787 | A1 | 7/2008 | Nasvik | |
| 2008/0253834 | A1 * | 10/2008 | Colvard | 404/84.05 |

* cited by examiner

*Primary Examiner* — Joseph Del Sole
*Assistant Examiner* — Nahida Sultana
(74) *Attorney, Agent, or Firm* — Dennis W. Beech

(57) ABSTRACT

The present invention may be attached to a vehicle for movement adjacent to a generally vertical wall structure for imprinting a pattern in a surface of the wall structure. An imprint form frame may be attached to an imprint form. The imprint form frame may be attached to a support frame that may be of generally rectangular form with horizontal and vertical members. The support frame may be attached to one or more position support members so as to be movable in a horizontal and perpendicular direction relative to the plane of the support frame. The perpendicular movement may be controlled by a power actuator. The position support member may be attached to a frame support beam for attachment to a vehicle and may be movable vertically.

14 Claims, 8 Drawing Sheets

TEXTURE PATTERN IMPRINTING APPARATUS

BACKGROUND OF THE INVENTION

This invention relates to apparatus and methods for imprinting patterns in generally vertical concrete structures that may be walls or roadway barriers. The new apparatus may be attached to a vehicle for movement along a vertical concrete structure as the concrete is being poured and formed to imprint the concrete with a pattern.

Various methods and apparatus may be known for creating patterns in elongated concrete structures that may be walls or roadway barriers. Some of these apparatus may use forms that are positioned prior to the pouring of concrete and the forms may remain in place until the concrete has cured to a desired extent. These forms may also be designed to be used cooperatively with wall paver or slip form concrete machines and vehicles such as those manufactured by Miller Formless Company, Inc., of McHenry, Ill.

Other methods may use a cylindrical roller or continuously moving belt with a pattern to be moved along a concrete structure to impress a pattern in the concrete. This type of apparatus may allow only limited pattern variability due to the roller or belt size. These apparatus may have limited imprint depth capability due to the amount of pressure or force that can be applied against the concrete surface.

There may be known hydraulic operated stamp apparatus that may be structured for use in a horizontal production type operation to create concrete panels. This type apparatus would not be usable in imprinting a generally vertical wall or barrier structure.

SUMMARY OF THE INVENTION

The present invention is directed to apparatus for attachment to a vehicle for movement adjacent to a generally vertical wall structure for imprinting a pattern in a surface of the wall structure. An imprint form frame may be attached to an imprint form. The imprint form frame may be attached to a support frame that may be of generally rectangular form with horizontal and vertical members. The support frame may be attached to one or more position support members so as to be movable in a horizontal and perpendicular direction relative to the plane of the support frame. The perpendicular movement may be controlled by a power actuator. The position support member may be attached to a frame support beam for attachment to a vehicle and may be movable vertically.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
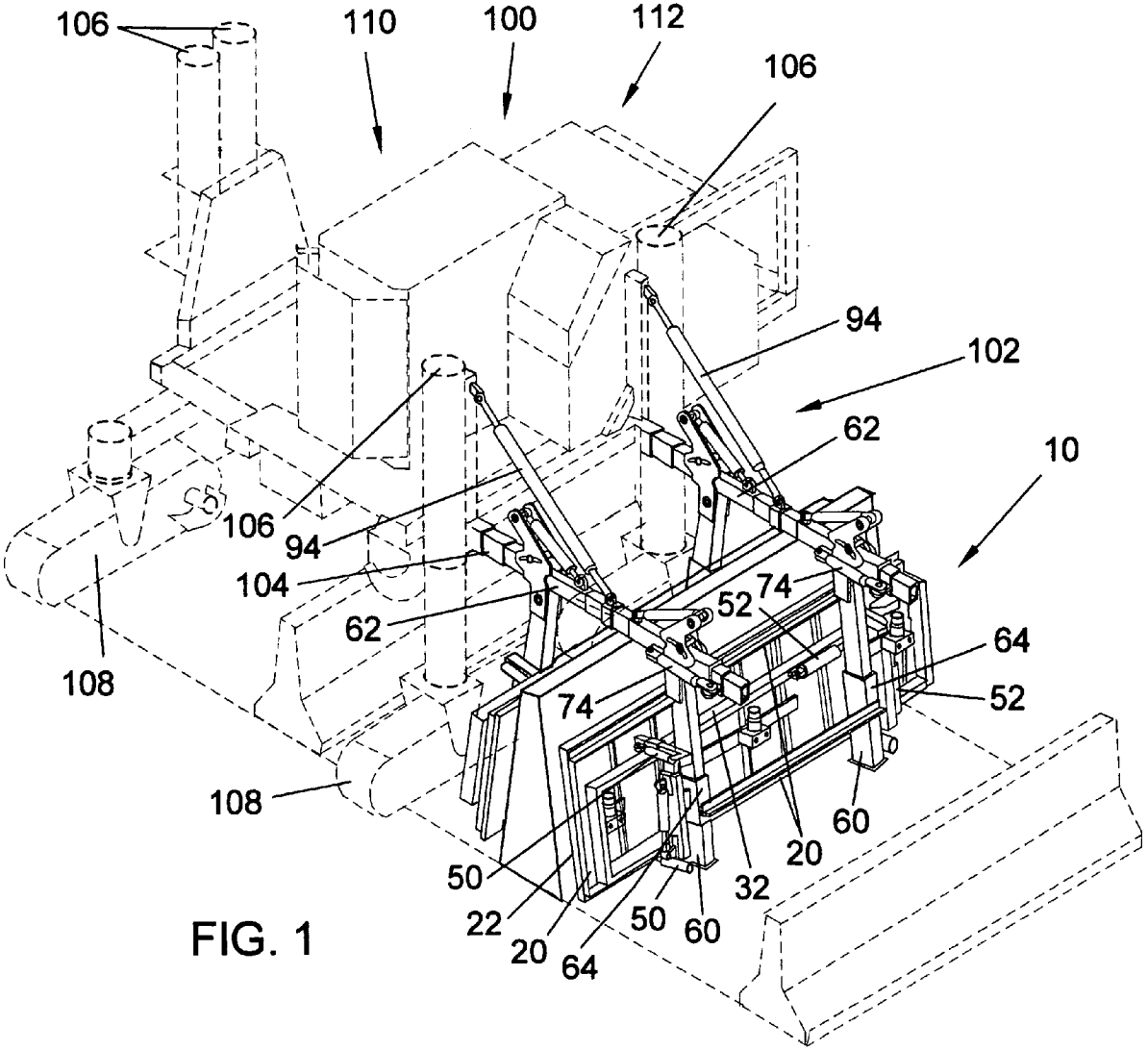
FIG. 1 illustrates a perspective view of a texture pattern imprinting apparatus attached on a side of a wall paver vehicle according to an embodiment of the invention.
Figure 2:
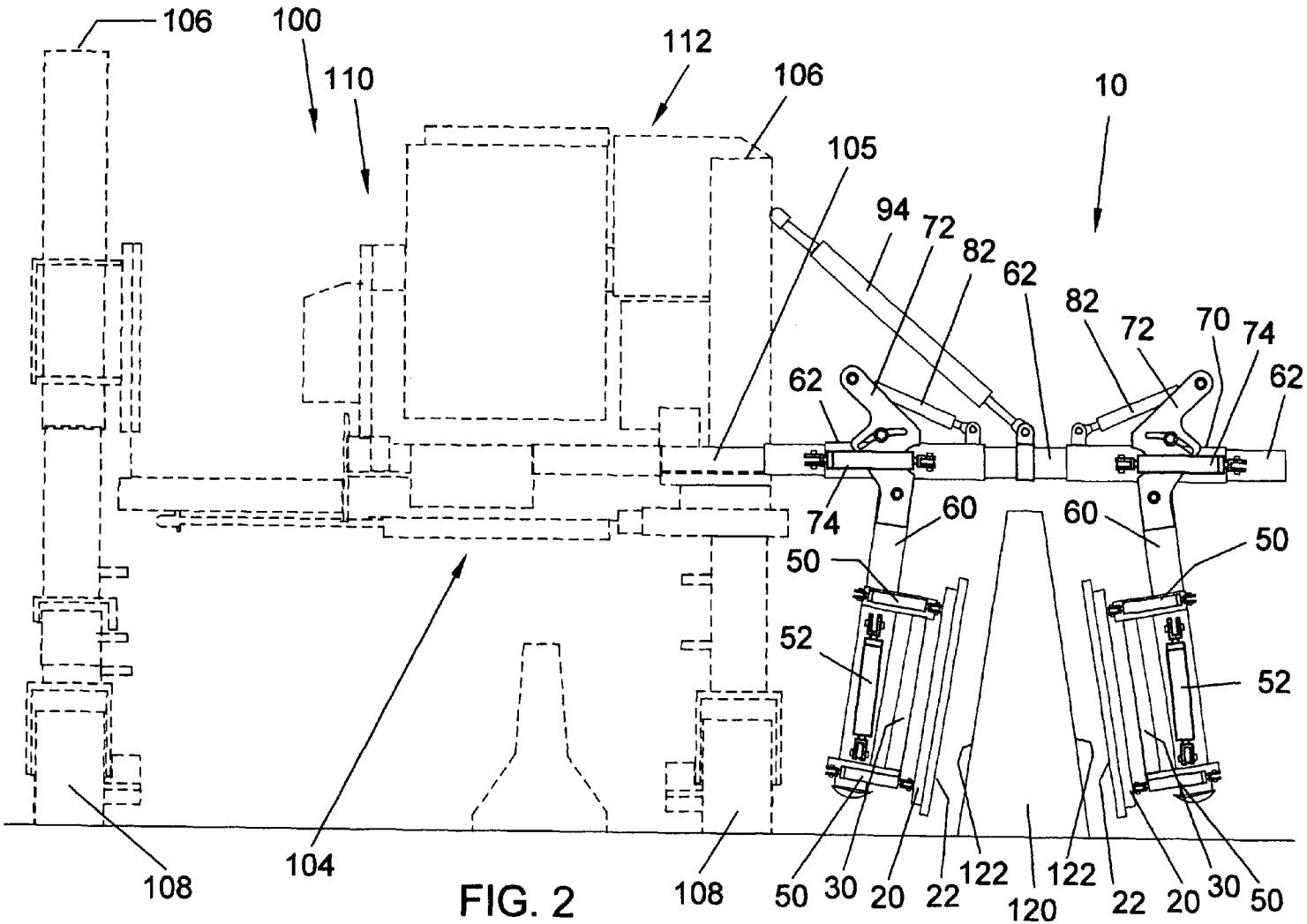
FIG. 2 illustrates a front elevation view of an imprinting apparatus attached on a side of a wall paver vehicle according to an embodiment of the invention.
Figure 3:
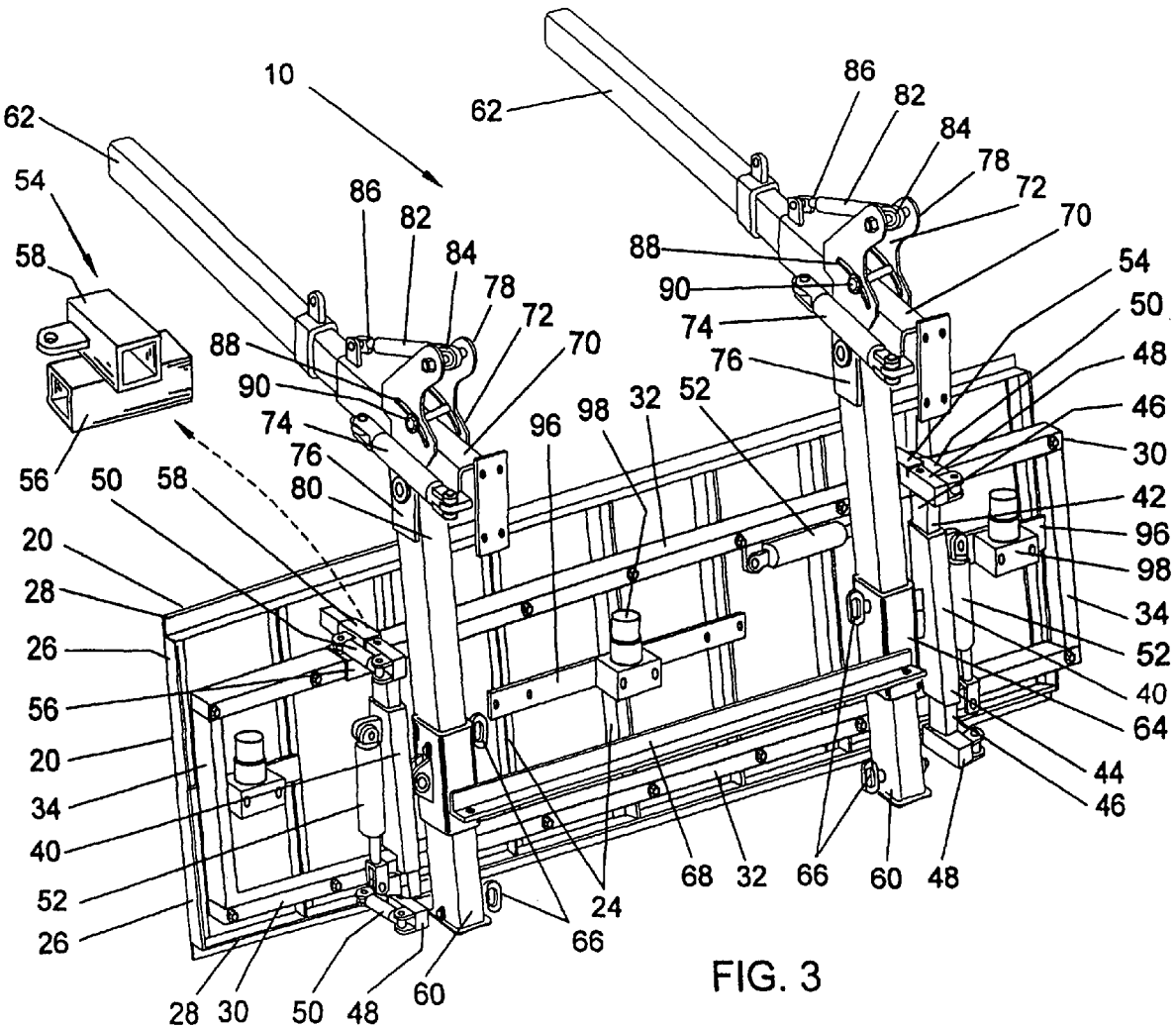
FIG. 3 illustrates a perspective view of an imprinting apparatus according to an embodiment of the invention.
Figure 4:
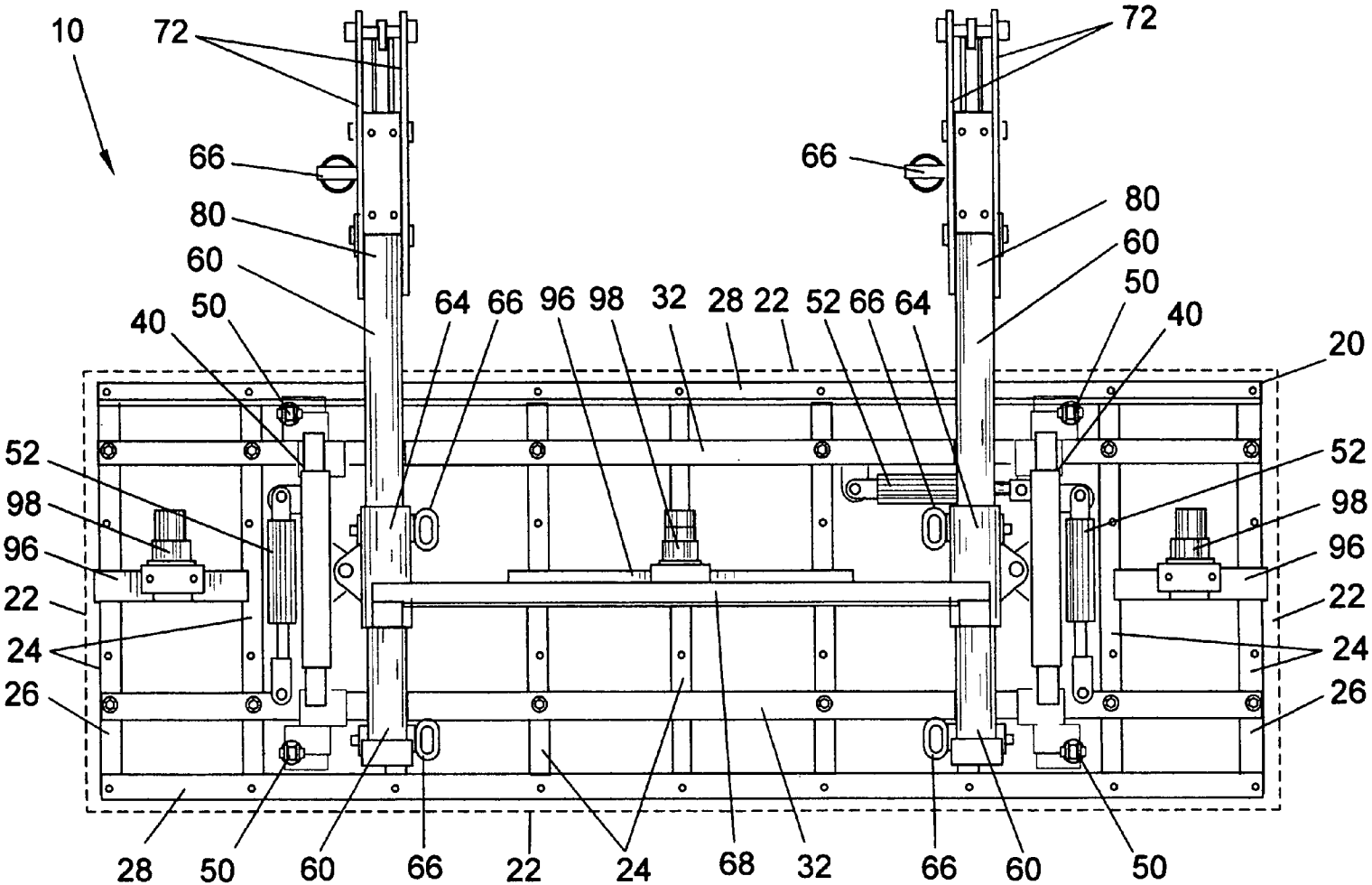
FIG. 4 illustrates a side elevation view of an imprinting apparatus according to an embodiment of the invention.
Figure 5:
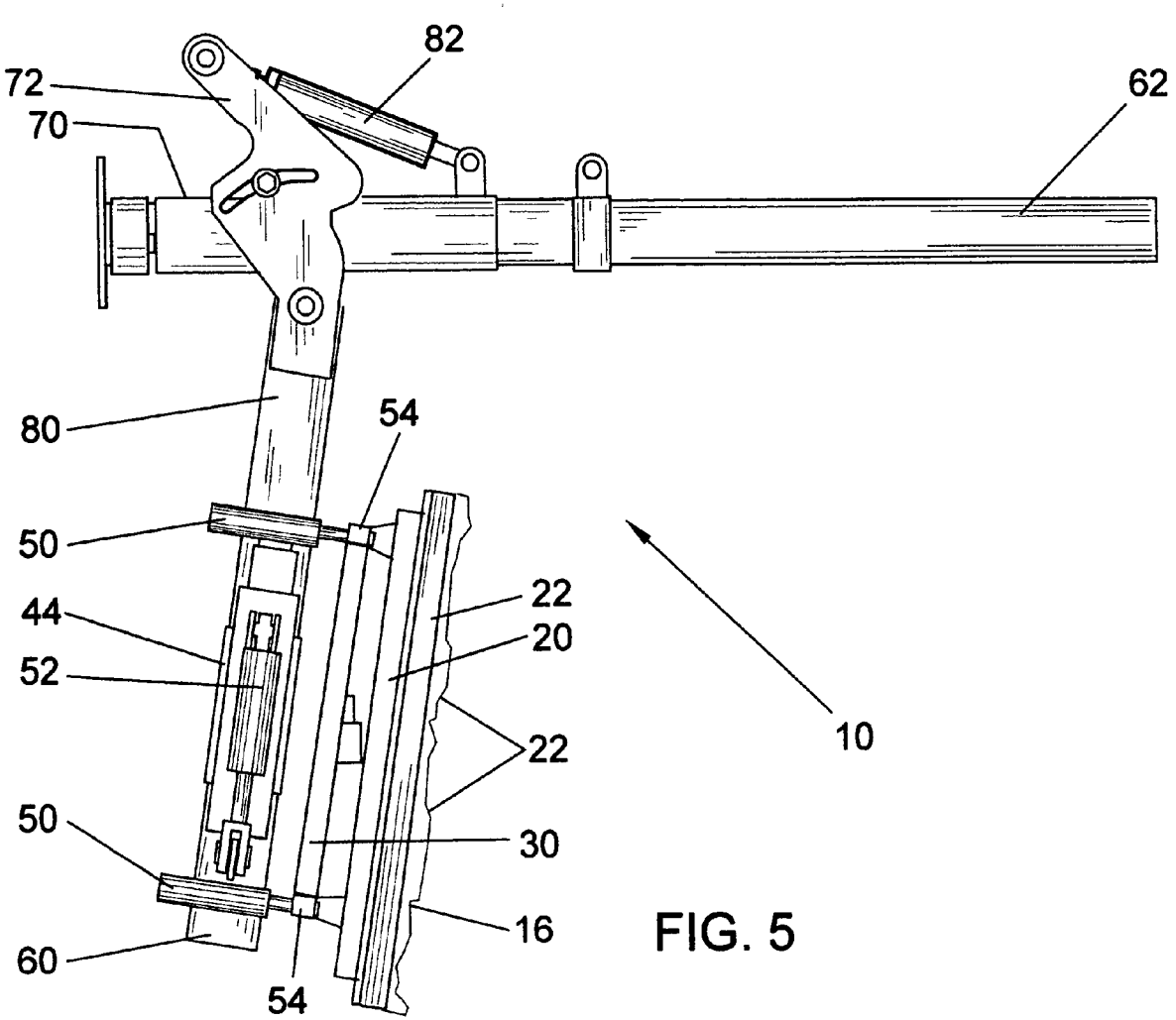
FIG. 5 illustrates an end elevation view of an imprinting apparatus according to an embodiment of the invention.

Referring to FIGS. 1 and 2, a texture pattern imprinting apparatus 10 for use with concrete structures, for example, vertical walls or roadway barriers may be attached to a wall paver or slip former vehicle 100. As illustrated in FIGS. 1 and 2, the imprinting apparatus 10 may be attached to one side 102 of a wall paver 100 relative to the direction of travel of the vehicle 100. The wall paver or slip former vehicle 100 is a vehicle as understood in the art of vertical barrier formation using concrete in a generally continuous motion concrete pouring operation. An example machine may be that manufactured by Miller Formless Company, Inc., of McHenry, Ill., that is currently identified by Model No. M-8800. Vehicles 100 of this type may have a frame 104 supported on hydraulic postionable elevation tubes 106 for use in adjusting the frame 104 height. The elevation tubes 106 may be mounted on movable powered track apparatus 108 to propel the vehicle 100 in a desired direction. There may be an engine 110 to power the vehicle 100 and a hydraulic control system 112 with hydraulic fluid supply and motors to power and control hydraulic actuator 114 operation.

The wall paver vehicle 100 may be structured to have a slip form wall paver apparatus (not shown) attached to one side 102 or between the elevation tubes 106. A charging hopper and transfer augers (not shown) may be used to move concrete to the paver apparatus for use in slip form wall construction as understood in the industry. Vibrating devices (not shown) may be strategically positioned to aid in concrete pouring. While an example wall paver vehicle 100 may be used to disclose embodiments of use of an imprinting apparatus 10, other transport vehicles may be used to carry and operate an imprinting apparatus 10 for cooperative operation with a slip form wall paver apparatus equipped vehicle 100. An approximately structure wall paver vehicle 100 may have both a slip form wall paver apparatus positioned forward of an imprinting apparatus 10 to allow slip forming a concrete vertical structure followed by imprinting the vertical structure using the same vehicle.

Referring to FIGS. 1 through 5, the imprinting apparatus 10 may have an imprint form frame 20 sized to hold an imprint form 22. The form frame 20 may be attached to a support frame 30 that may be slidably attached to a vertical and horizontal positioning support member 40. Hydraulic actuators 52 may be used to position the imprint form frame 20 horizontally and vertically prior to imprint hydraulic actuators 50 moving the imprint form 22 against a concrete surface 122 of a wall 120.

The positioning support members 40 may be attached to generally vertical frame support beams 60 that may be movably attached to generally horizontal attachment beams 62.

The attachment beams 62 may be slidably inserted in frame beams 105 of frame 104 for attachment to vehicle 100 or otherwise attached to a vehicle 100 for movement and positioning along a wall 120.

The imprint form frame 20 may be of generally rectangular open beam form having multiple vertical beams 24 attached at upper and lower ends 26 by horizontal beams 28. The lengths of beams 24, 28 and the number of beams 24 may be determined by the desired size of the imprint for a wall surface, whether or not it is repetitive. The beams 24, 28 may be attached by fasteners, welding or other suitable attachment method. The imprint form frame 20 may have one or more vibrator devices 98 attached to aid in causing a desired impression in a concrete surface. The vibrator devices 98 may be attached to elongated bars 96 for attachment to two or more vertical beams 24 to allow a distributed effect to the imprint form 22.

The support frame 30 may have a pair of horizontal members 32 attached to a pair of vertical members 34 in a rectangular form having a horizontal length approximately equal to that of the form frame 20. The support frame 30 may be attached to the form frame 20 by bolts 130 or other suitable fastening methods.

The vertical and horizontal positioning support members 40 may have an elongated bar member 42 that may be rectangular in cross section that may be slidably inserted through an attachment sleeve 44. The bar member 42 may have attached at each end 46 a horizontal frame bar 48 oriented to be approximately orthogonal to the bar member 42 and to the support frame 30. An orthogonal junction device 54 may have a first sleeve 56 slidably positioned on a horizontal member 32 to allow horizontal movement of the support frame 30. A second sleeve 58 attached orthogonal to said first sleeve 56 may be slidably positioned on a frame bar 48 to allow movement of the support frame 30 toward and away from a surface to be imprinted. The horizontal motion of support frame 30 may be controlled by a hydraulic actuator 52 attached to horizontal member 32 and to junction device 54. The support frame 30 may be moved to force an imprint form 22 against a surface to be imprinted as controlled by imprint hydraulic actuators 50 attached to a frame bar 48 and to the second sleeve 58.

The attachment sleeve 44 of the positioning support member 40 may be attached to a frame support sleeve 64 slidably positioned on a frame support beam 60. This frame support sleeve 64 may allow generally vertical positioning of the support frame 30. The attachment sleeve 44 may also allow generally vertical positioning of the support frame 30. As illustrated in the Figures, the attachment sleeve 44 may be positioned by a hydraulic actuator 52 attached to the sleeve 44 and to the bar member 42. The frame support sleeve 64 may be positioned manually prior to use based on the wall structure to be imprinted and the sleeve 64 fixed in position on the beam 60 by pins 66 or other fasteners. When two or more frame support beams 60 and sleeves 64 may be used the separation distance may be maintained by a span bar 68 attached to each sleeve 64.

The frame support beam 60 may be movably attached to the attachment beam 62 by an attachment beam sleeve 70 positioned on the beam 62 and an angularly rotatable bracket 72. The movement of the sleeve 70 may be controlled by a hydraulic actuator 74 attached to the sleeve 70 and to the attachment beam 62. The bracket 72 may be fixedly attached at a first end 76 to the upper end 80 of the frame support beam 60. A second end 78 of the bracket 72 may have a rod 82 attached at one end 84 and the rod 82 may be attached at the other end 86 to the sleeve 64. The rod 82 may be a threaded telescoping rod to allow varying the length. The bracket 72 may have a slot 88 formed intermediate the first end 76 and second end 78 with bolts 90 inserted therethrough for attachment to the bracket 72. The position of the bolt 90 in the slot 88 may determine the general vertical orientation of the frame support beam 60.

Figure 6:
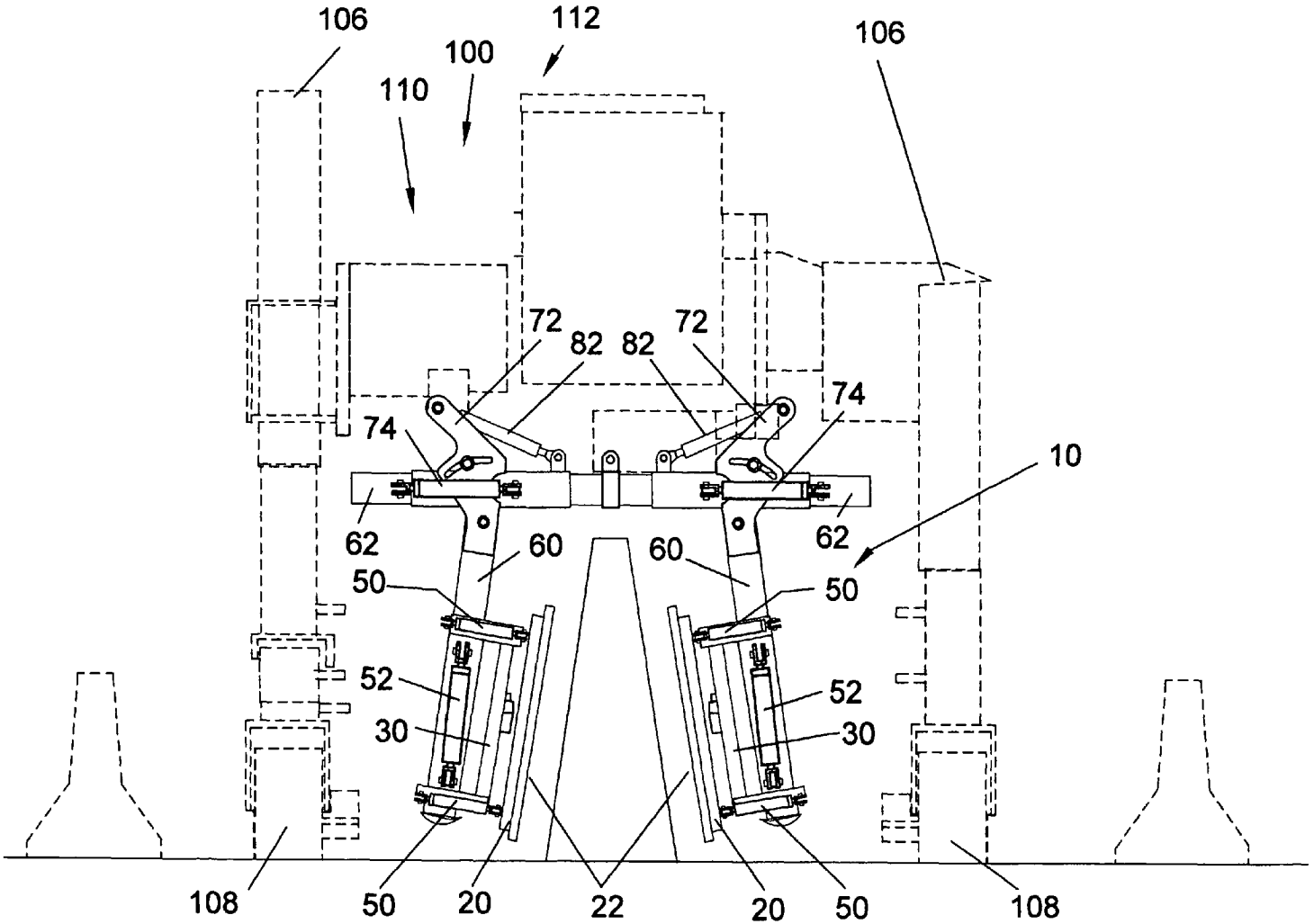
FIG. 6 illustrates a front elevation view of an imprinting apparatus attached between the elevation tubes of a wall paver vehicle according to an embodiment of the invention.

Referring to FIG. 6, a vehicle 100 with an imprinting apparatus 10 attached between the elevation tubes 106 is illustrated.

Figure 7:
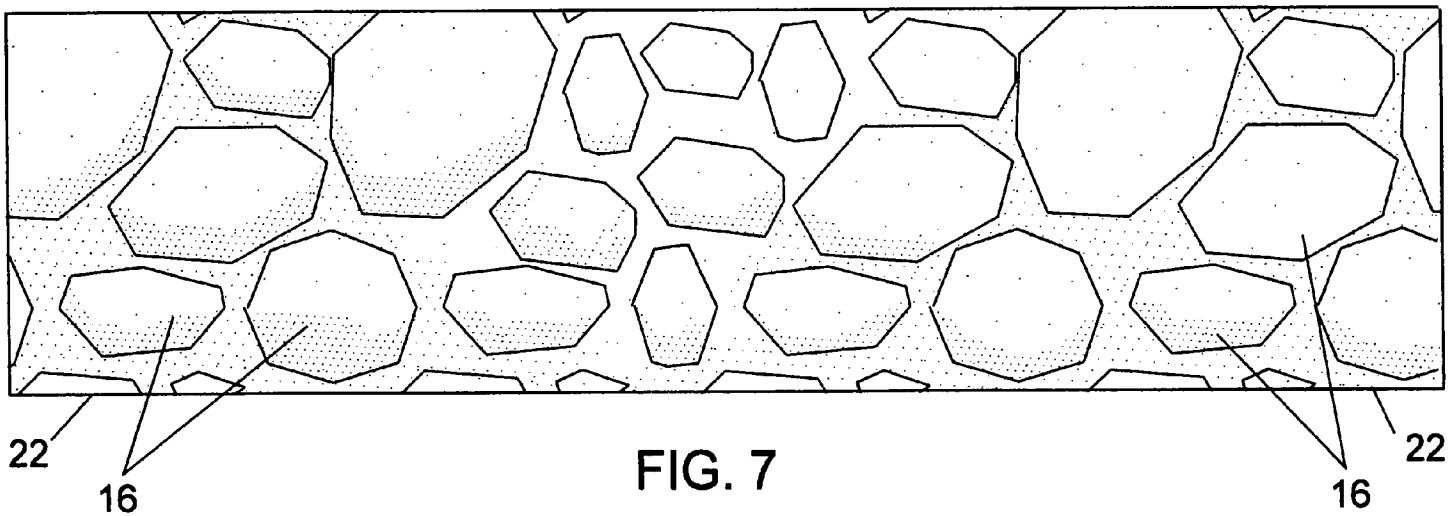
FIG. 7 illustrates a plan elevation view of an imprint form according to an embodiment of the invention.
Figure 8:
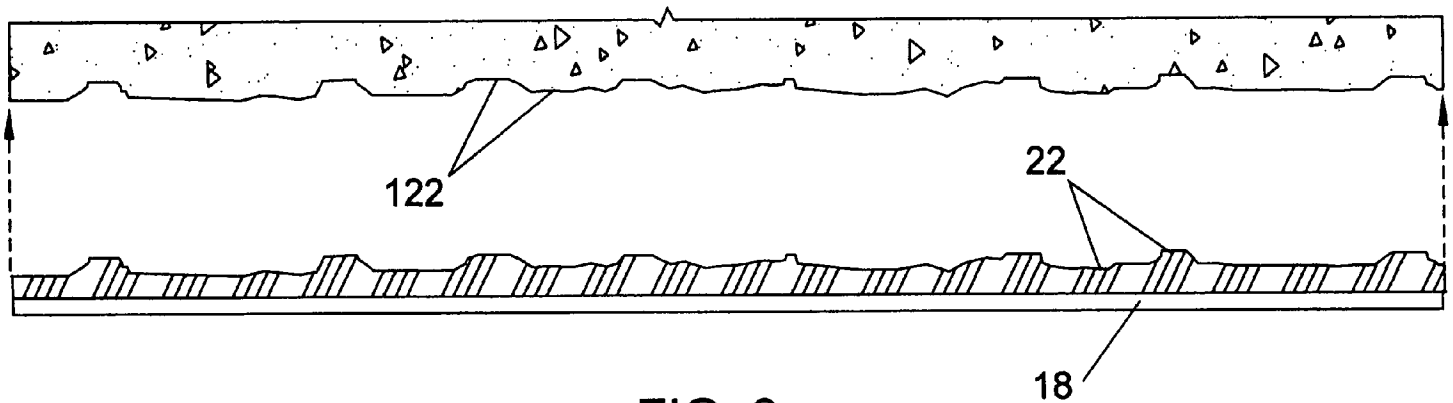
FIG. 8 illustrates a section view of an imprint form according to an embodiment of the invention.

Referring to FIGS. 7 and 8, an example of a patterned imprint form 22 is illustrated that may simulate a stone barrier when imprinted in concrete. The base 18 may be a wood, plywood or other suitable structure. The pattern 16 may be formed from a vulcanized rubber material to create the shapes of stones and spaces between stones. This form 22 may be attached to the imprint form frame 20. While a stone barrier pattern has been used as an example, any appropriate pattern desired for a wall may be used.

Figure 9:
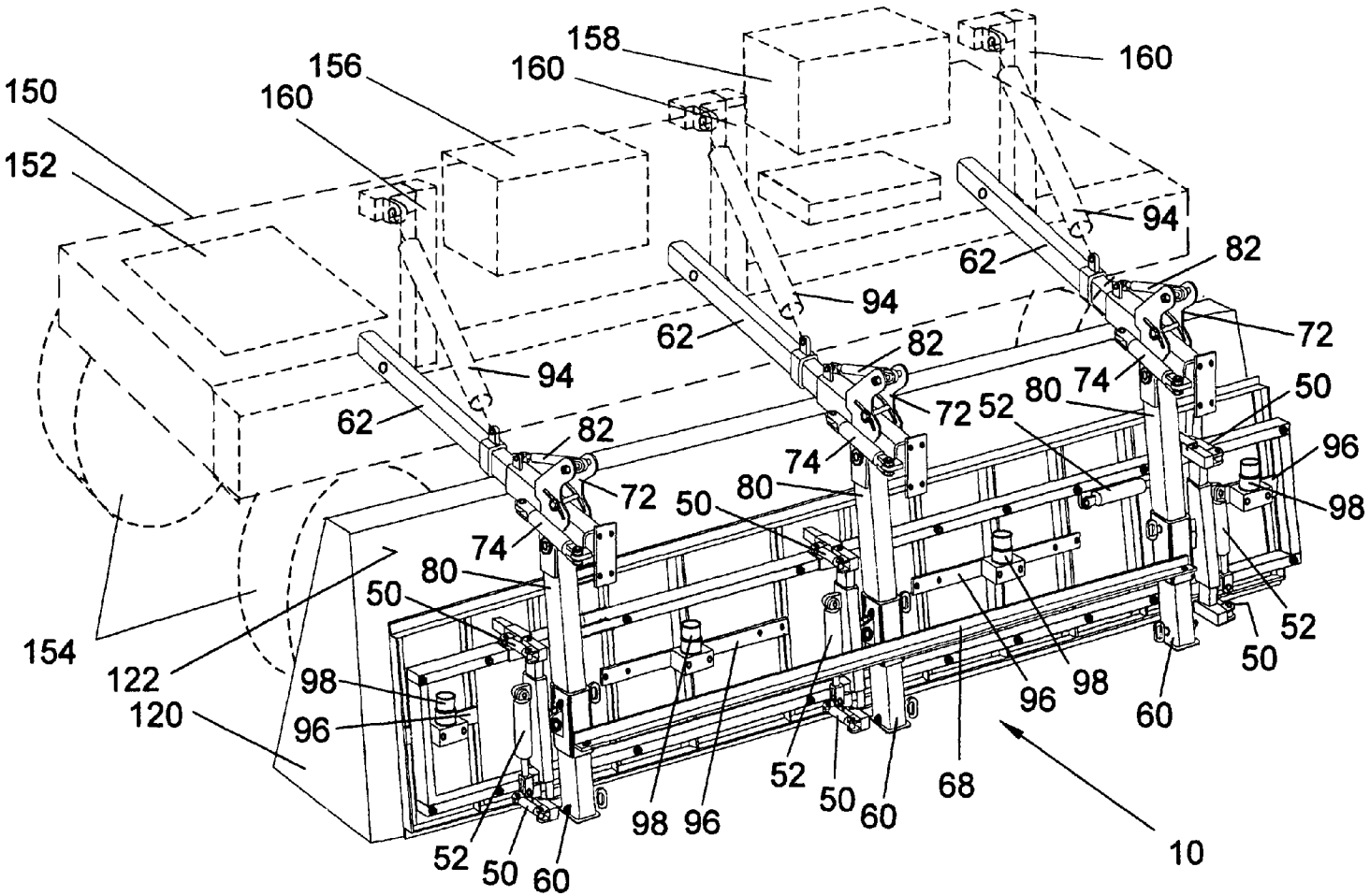
FIG. 9 illustrates a perspective view of a texture pattern imprinting apparatus attached to a transport vehicle according to an embodiment of the invention.

Referring to FIG. 9, a transport vehicle 150 with an imprinting apparatus 10 attached is illustrated. The imprinting apparatus may have three or more position support members 40 movably attached to frame support beams 60, three are illustrated in the Figure, which may be attached to attachment beams 62 for attachment to a vehicle.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus attachable to a vehicle for movement adjacent to a generally vertical wall structure for imprinting a pattern in a surface of the wall structure comprising: an imprint form that is attached to an imprint form frame; a support frame of generally rectangular form that has at least two horizontal members attached to at least two vertical members and to which said imprint form frame is attached; said support frame movably attached to a position support member to allow movement horizontally, vertically and perpendicularly relative to the plane of said support frame wherein perpendicular movement is controlled by an imprint actuator; and said position support member movably attached to a frame support beam that is oriented generally vertically to allow movement of said positioning support member in a generally vertical direction; wherein: said position support member has a bar member with a frame bar attached orthogonally at each end; a junction device has a first sleeve attached orthogonally to a second sleeve to be slidably disposed on each of said horizontal members wherein said first sleeve of each junction device is slidably disposed on each horizontal member, and said second sleeve is slidably disposed on one of each of said frame bars; and said support frame is movable and fixable in the horizontal direction and said imprint actuator is attached to each of said junction devices and to each of said frame bars.

2. The apparatus as claim 1 wherein each of said imprint actuators is a hydraulic actuator.

3. The apparatus as in claim 1 wherein a frame actuator is attached to one of said junction devices and to one of said horizontal members.

4. The apparatus as in claim 3 wherein said frame actuator is a hydraulic actuator.

5. The apparatus as in claim 1 wherein:

said positioning support member has a bar member with an attachment sleeve slidably disposed thereon; and said attachment sleeve is attached to a frame support sleeve slidably disposed on said frame support beam.

6. The apparatus as in claim 5 wherein movement of said attachment sleeve is controlled by a power actuator attached to said bar member and said attachment sleeve.

7. The apparatus as in claim 6 wherein said power actuator is a hydraulic actuator.

8. The apparatus as in claim 5 wherein said frame support sleeve may be fixed in position on said frame support beam by a pin.

9. The apparatus as in claim 1 wherein said imprint form frame is generally a rectangular structure with a plurality of vertical beams attached at beam ends to two horizontal beams.

10. The apparatus as in claim 9 wherein said plurality of vertical beams are bolted to said support frame.

11. The apparatus as in claim 9 wherein at least one vibrator device is attached to said imprint form frame and to a power source.

12. The apparatus as in claim 1 wherein there are at least two position support members and at least two frame support beams.

13. The apparatus as in claim 1 wherein:

said frame support beam is attached at an upper end to a first end of a bracket;

an attachment beam sleeve is slidably disposed on an attachment beam;

said bracket is disposed adjacent to said attachment beam sleeve with a second end extending above said attachment beam sleeve and a rod is connected at a rod first end to said attachment beam sleeve and at a rod second end to said second end;

said bracket having a slot formed therein intermediate said first end and said second end for insertion of a bolt to be disposed on said attachment beam sleeve; and a power actuator attached to said attachment beam sleeve and to said attachment beam.

14. The apparatus as in claim 13 wherein said power actuator is a hydraulic actuator.

* * * * *